US005709422A

United States Patent [19]

Malone

[11] Patent Number: 5,709,422

[45] Date of Patent: Jan. 20, 1998

[54] SECURITY DEVICE FOR DOUBLE DOORS

[76] Inventor: James Carl Malone, 12758 Maricopa Way, Jacksonville, Fla. 32246

[21] Appl. No.: 664,193

[22] Filed: Jun. 10, 1996

[51] Int. Cl.[6] ..... E05C 19/18

[52] U.S. Cl. ..... 292/288; 292/289; 292/246; 292/DIG. 21

[58] Field of Search ..... 292/289, 288, 292/292, 246, 253, DIG. 2, DIG. 21

[56] References Cited

U.S. PATENT DOCUMENTS

| | | | |
|---|---|---|---|
| 694,975 | 2/1902 | Simmons | 292/246 X |
| 2,151,587 | 3/1939 | Cassileth | 292/288 |
| 2,899,229 | 8/1959 | Jenks | 292/288 |
| 3,843,179 | 10/1974 | Reck | 292/288 X |
| 4,281,865 | 8/1981 | Nicholson | 292/246 X |
| 4,478,442 | 10/1984 | Martin | 292/246 X |
| 5,294,160 | 3/1994 | Arthur | 292/288 X |
| 5,465,595 | 11/1995 | Sheppard | 292/246 X |

*Primary Examiner*—Rodney M. Lindsey
*Attorney, Agent, or Firm*—Thomas C. Saitta

[57] ABSTRACT

A security device for double doors having adjacent handles which comprises a lateral bracing segment which extends across the two handles, a short depending segment connected to the lateral bracing segment by a first loop encompassing the neck of the first handle, and a depending bracing segment connected to the lateral bracing segment by a second loop encompassing the neck of the second handle, where the depending bracing segment extends back across the juncture between the double doors.

12 Claims, 1 Drawing Sheet

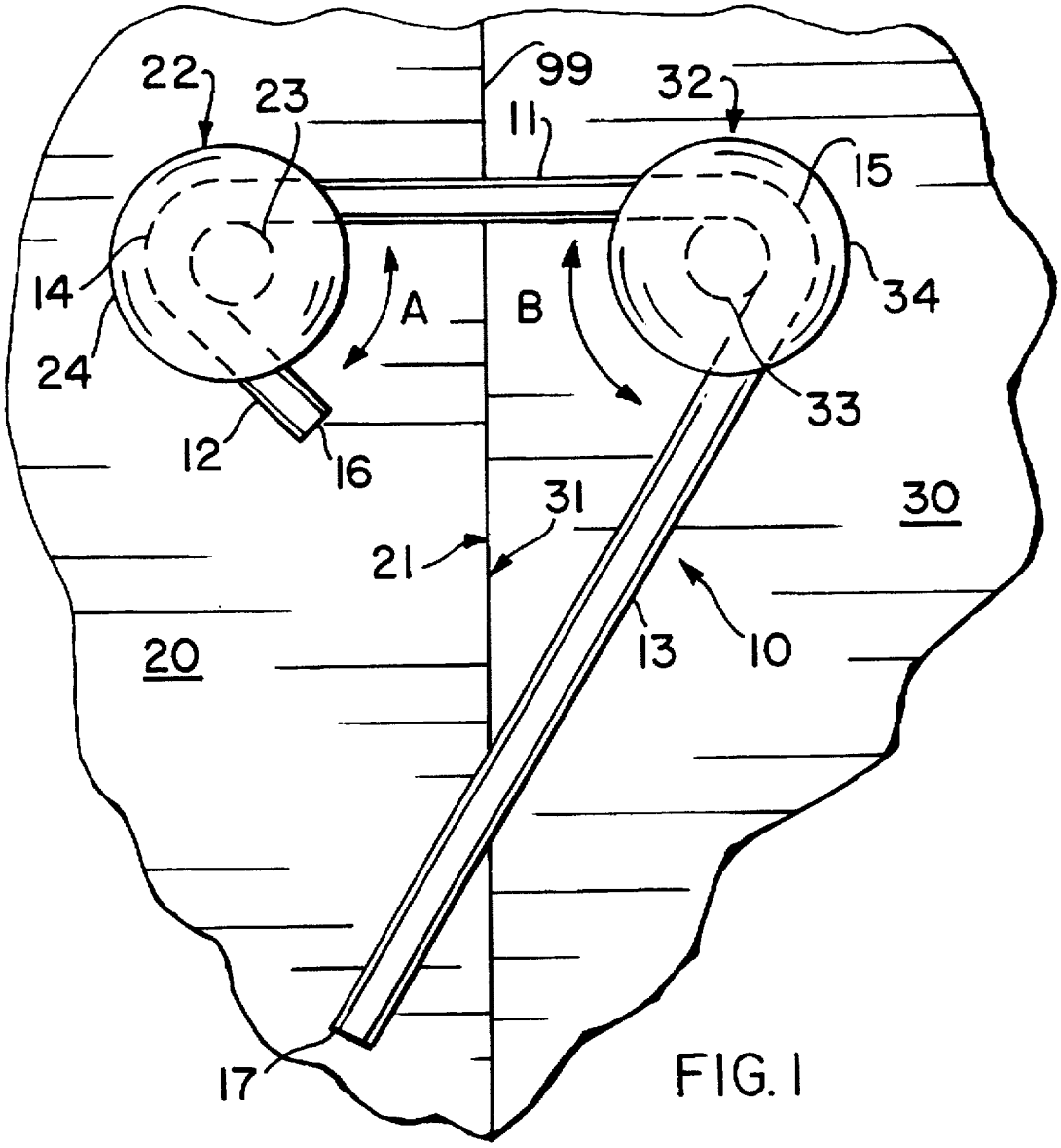
FIG. 1
FIG. 2
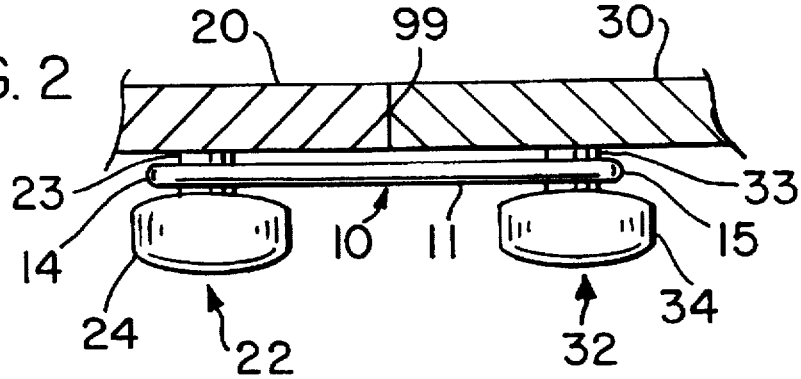

SECURITY DEVICE FOR DOUBLE DOORS

BACKGROUND OF THE INVENTION

This invention relates generally to the field of secondary security devices externally mounted onto adjacent interior handles of double doors. More particularly, the invention relates to such devices which are comprised of a unitary rigid member configured to provide two bracing segments across the juncture of the double doors.

Double or dual doors which are hinged to a peripheral door jamb along the outer edge of each door and which close such that the inner edge of each door meets at a juncture in the middle are well known. These doors present a security problem since the most common configuration is to provide an adjacent set of handles, one of which when rotated retracts a bolt extending from one door into a lock plate on the other door. The bolt in the handle lock has a bevelled side to allow it to be forced inward when the door is closed without the handle being rotated, which has the deficiency of providing a surface which allows the lock to be opened relatively easily from the outside of the doors be forcing an object against the bevelled surface. Sometimes a second retractable bolt, known as a deadbolt, is also installed between the double doors, since the bolt on this type of lock cannot be forced inward from the outside. Because of the nature of the construction of double doors, whereby there is no middle jamb member, the inner edges of the two doors must secure to each other and are therefore easily forced open even when a deadbolt is installed by applying enough pressure from the outside.

To address this problem, secondary security devices have been developed which are designed to be mounted onto the adjacent interior door handles. These devices must be removed from the handles in order to open the doors. Examples of similar devices are seen in U. S. Pat. No. 2,151,587 to Cassileth, U.S. Pat. No. 4,082,334 to Volta et al. and U.S. Pat. No. 5,501,493 to Arthur. Cassileth shows a simple device composed of a resilient flat bar formed with two loops to surround the necks of adjacent door handles. To apply or remove the device, the loops are pulled open by the user and then released after they are positioned over the handle. Volta et al. shows a flat plate having two elongated slots to receive the handle necks. The slots are of different lengths, whereby the device is applied by first positioning the longer slot over the first knob, then pivoting the device to position the short slot over the second knob, and then moving the device horizontally to secure both knobs. Arthur shows a plate with two vertically oriented slots open on the bottom of the plate and two spring biased locking pins. When the device is dropped onto the adjacent handles, the locking pins extend beneath the handles to close off the slots. The pins must be withdrawn to remove the device from the handles.

It is an object of this invention to provide a secondary external security device for securing double doors, which is mounted onto the interior door handles whereby the device prevents the doors from being opened from the outside. It is a further object to provide such a device which has two bracing members extending across the juncture of the double doors. It is a further object to provide such a device which is a unitary rigid member having no moving component parts.

SUMMARY OF THE INVENTION

The invention is a secondary security device for use on double doors having adjacent handles, the device being configured to be mounted onto and between the handles on the interior side of the doors, thereby preventing the doors to be pivoted open unless the device is removed from at least on handle. The device provides two bracing segments across the juncture of the two doors, the first extending laterally between the two handles and the second extending angularly downward from one handle. The device is a unitary rigid member, preferably constructed of a metal rod having a circular cross-section, which is bent by machine into the desired configuration. The security device comprises a lateral bracing member extending horizontally between the two door handles, a short depending segment and an extended depending bracing segment. The two depending segments are angularly joined to the lateral bracing segment, preferably by a first and second loop, at interior angles of less than 90 degrees. The length of the depending bracing member is sufficient such that it extends back across the door juncture at a point below the door handles.

BRIEF DESCRIPTION OF THE DRAWINGS

FIG. 1 is a front view of the invention as shown positioned on adjacent door handles of a set of double doors.

FIG. 2 is a vertical view of the invention positioned on the door handles.

DETAILED DESCRIPTION OF THE INVENTION

With reference to the accompanying drawings, the invention will now be described in detail with specific regard to the best mode and preferred embodiment. The invention is in general a secondary security device for securing double or dual doors by mounting the device onto the interior adjacent door handles. As shown in the figures, the security device 10 is utilized in combination with double doors comprising a first door 20 having a first handle 22 with a slender neck portion 23 and wider head or gripping member 24 and a second door 30 having a second handle 32 with a slender neck portion 33 and wider head or gripping member 34. The two doors 20 and 30 are hinged on their outer edges such that when closed their inner edges, 21 and 31 respectively, meet to form a vertical door juncture 99. The handles 22 and 32 are mounted near the door juncture 99.

The device 10 comprises in general a lateral bracing segment 11, a relatively short depending segment 12 and a relatively extended depending bracing segment 13, each preferably generally linear in configuration. The device 10 is composed of a strong, rigid material with relatively no flexibility or elasticity by hand applied force such as metal or the like. Preferably, the device 10 is composed of a solid, cylindrical metal bar or rod having circular cross-section, although other cross-sectional configurations such as square, rectangular, hexagonal or the like are possible, as well as the use of tubular material.

The lateral bracing segment 11 is sized to extend the distance between the necks 23 and 33 of adjacent handles 22 and 32 whereby it can be positioned superior to the necks 23 and 33. The short depending segment 12 is joined to the lateral bracing segment 11 at an interior angle A of less than 90 degrees and preferably between approximately 50 and 60 degrees, such that depending segment 12 extends beneath neck 23 of handle 22 in a non-vertical manner in the direction of interior edge 21. The depending segment 12 could also be configured to be parallel to the lateral bracing segment 11, or could even have be directed back toward the lateral bracing segment 11 to form a negative relative angle. The length of depending segment 12 is preferably such that the first end 16 extends beyond a vertical line positioned at the inner edge of neck 22. While the junction between the short depending segment 12 and the lateral bracing segment 11 can have many configurations, such as angled, squared or radiused, it is preferred that depending segment 12 and lateral bracing segment 11 be joined in radiused manner by first loop 14, since the neck 23 of door handle 23 is most likely to be circular in cross-section. The first loop 14 partially encompasses neck 23. Because the head 24 of handle 22 is much larger than the neck 23, the first loop 14 must be positioned on door handle 22 by sliding the device 10 in a direction parallel to the plane of the door 20. The head 24 prevents installation or removal of the device 10 in the direction perpendicular to the door 20.

The depending bracing segment 13 is joined to the opposing end of lateral bracing segment 11 such that it partially encompasses the neck 33 of handle 32 on the second door 30. The depending bracing segment 13 is joined to lateral bracing segment 11 and is of sufficient length such that it extends back across interior edge 31, door juncture 99 and interior edge 21 of the first door 20 and such that second end 17 is positioned on first door 20. The interior angle B formed between depending bracing segment 13 and lateral bracing segment 11 is less than 90 degrees and preferably between 55 and 65 degrees, and the two members are preferably joined in a radiused manner by second loop 15, although other configurations for the junction are possible. The extended dimension of head 34 versus neck 33 on door handle 32 prevents the second loop 15 from being removed from the door handle 32 in a direction perpendicular to the plane of door 30.

While absolute dimensions may vary depending on the separation distance between adjacent handles 22 and 32 of doors 20 and 30, a representative configuration for example only could comprise a security device 10 made of cylindrical steel stock, commonly referred to as rebar, with cross-sectional diameter of ⅜ inches, with the lateral brace member extending approximately 9 inches, the short depending segment 12 extending approximately 3 inches at an interior angle A of 55 degrees, and the depending bracing segment extending approximately 18 inches at an interior angle B of 60 degrees. It is also preferred to provide a cover or coating, such as a plastic, on the device 10 to protect the door handles 22 and 23 and doors 20 and 30.

To use the security device 10, the first loop 14 is slid onto the neck 23 of handle 22 on first door 20 such that the lateral bracing segment 11 is above the neck 23 and the depending segment 12 is below. The device 10 is then rotated or pivoted about door handle 22 such that second end 17 passes beyond neck 33 of handle 32 on second door 30 and second loop 15 encompasses a portion of neck 33 with lateral bracing segment 11 resting on neck 33. In this position, the second end 17 is located behind first door 20 and depending brace segment 13 extends across door juncture 99 between interior door edges 21 and 31 well below lateral bracing segment 11 and door handles 22 and 32. To remove the device 10, the depending bracing segment is pivoted back above door handle 32 of second door 30 until second end 17 clears the neck 33, and then the device is slid in parallel manner to the plane of door 20 to remove it completely from handle 22 of first door 20.

Thus, with the security device 10 installed the double doors 20 and 30 cannot be opened since the first and second loops 14 and 15 entrap the door handles 22 and 32 and prevent the separation necessary to swing either one or both doors 20 and 30. The doors 20 and 30 are secured regardless of whether they open inwardly or outwardly. The enlarged heads 24 and 34 prevent the device 10 from being pushed off of handles 22 and 32 in the direction perpendicular to the plane of the doors 20 and 30. The device 10 cannot be removed form the outside by inserting a thin tool through door juncture 99 and lifting it vertically, as the depending segment 12 and depending bracing segment 13 are attached to lateral bracing segment 11 at interior angles of less than 90 degrees. The doors 20 and 30 cannot be forced open by exteriorly applied pressure since the device 10 provides two bracing elements, the lateral bracing segment 11 between the two handles 22 and 32 and the depending bracing segment 13 positioned across the door juncture 99 at a point well below the lateral bracing member 11.

It is contemplated that equivalents or substitutions for certain elements described above may be obvious to those skilled in the art, and therefore the true scope and definition of the invention is to be as set forth in following claims.

I claim:

1. A security device for double doors which meet at a juncture between adjacent handles with necks and enlarged heads, the device comprising a rigid, generally linear, lateral bracing segment, a rigid, generally linear, depending segment connected to said lateral bracing segment at an interior angle of less than 90 degrees and a rigid, generally linear, depending bracing segment connected to said lateral bracing segment at an interior angle of less than 90 degrees, said depending segment being shorter than said depending bracing segment, said depending bracing segment of sufficient length to extend across said juncture when said lateral bracing segment is positioned on said door handle necks, and where said device has a generally triangular configuration.

2. The device of claim 1, where said depending segment is connected to said lateral bracing segment by a first loop which partially encompasses the neck of one of said handles, and where said depending bracing segment is connected to said lateral bracing segment by a second loop which partially encompasses the neck of the other of said handles.

3. The device of claim 2, where said depending segment is connected to said lateral bracing segment at an interior angle of between 50 and 60 degrees.

4. The device of claim 3, where said depending bracing segment is connected to said lateral bracing segment at an interior angle of between 55 and 65 degrees.

5. The device of claim 1, where said depending bracing segment is connected to said lateral bracing segment at an interior angle of between 55 and 65 degrees.

6. The device of claim 1, where said depending segment is connected to said lateral bracing segment at an interior angle of between 50 and 60 degrees.

7. A security device in combination with double doors which meet at a juncture between adjacent handles with necks and enlarged heads, the device comprising a rigid, generally linear, lateral bracing segment, a rigid, generally linear, depending segment connected to said lateral bracing segment at an interior angle of less than 90 degrees and a rigid, generally linear, depending bracing segment connected to said lateral bracing segment at an interior angle of less than 90 degrees, whereby said device has a generally triangular configuration, said depending segment being shorter than said depending bracing segment and said depending bracing segment of sufficient length to extend across said juncture when said lateral bracing segment is positioned on said door handle necks.

8. The device of claim 7, where said depending bracing segment is connected to said lateral bracing segment at an interior angle of between 55 and 65 degrees.

9. The combination of claim 7, where said depending segment is connected to said lateral bracing segment by a first loop which partially encompasses the neck of one of said handles, and where said depending bracing segment is connected to said lateral bracing segment by a second loop which partially encompasses the neck of the other of said handles.

10. The device of claim 9, where said depending segment is connected to said lateral bracing segment at an interior angle of between 50 and 60 degrees.

11. The device of claim 10, where said depending bracing segment is connected to said lateral bracing segment at an interior angle of between 55 and 65 degrees.

12. The device of claim 7, where said depending segment is connected to said lateral bracing segment at an interior angle of between 50 and 60 degrees.

* * * * *